United States Patent [19]

Kallestad et al.

[11] 4,281,489

[45] Aug. 4, 1981

[54] FLOOR SUPPORT FOR GRAIN DRYING AND STORAGE BIN

[75] Inventors: Daniel R. Kallestad; David F. Barr, both of Blue Earth, Minn.

[73] Assignee: Continental Agri-Services, Inc., Blue Earth, Minn.

[21] Appl. No.: 78,294

[22] Filed: Sep. 24, 1979

[51] Int. Cl.[3] ..... E04H 7/00

[52] U.S. Cl. ..... 52/192; 52/664; 52/690

[58] Field of Search ..... 52/263, 247, 192, 303, 52/686, 687, 690, 650, 677, 664

[56] References Cited

U.S. PATENT DOCUMENTS

| | | | |
|---|---|---|---|
| 3,426,445 | 2/1969 | Steffen . | |
| 3,438,517 | 4/1969 | Steffen . | |
| 3,512,322 | 5/1970 | Steffen | 52/263 |
| 3,591,994 | 7/1971 | Steffen | 52/648 |
| 3,592,447 | 7/1971 | Steffen | 259/102 |
| 3,638,331 | 2/1972 | Steffen | 34/231 |
| 3,685,232 | 8/1972 | Steffen | 52/742 |
| 3,907,065 | 9/1975 | Steffen | 182/95 |
| 3,979,871 | 9/1976 | Pollock | 52/247 X |
| 3,991,913 | 11/1976 | Steffen | 222/156 |
| 4,004,352 | 1/1977 | Steffen | 34/233 |
| 4,020,565 | 5/1977 | Steffen | 34/93 |
| 4,037,527 | 7/1977 | Steffen | 98/55 |
| 4,045,878 | 9/1977 | Steffen | 34/26 |
| 4,053,991 | 10/1977 | Steffen | 34/54 |

*Primary Examiner*—Carl D. Friedman

*Attorney, Agent, or Firm*—Dorsey, Windhorst, Hannaford, Whitney & Halladay

[57] ABSTRACT

A floor support for supporting a perforated floor in a grain drying and storage bin of the type having a plenum chamber and a grain drying and storage chamber. The floor support includes a plurality of floor support members each comprising at least three vertically disposed tubular members joined together near their tops and bottoms by a pair of horizontally disposed brace members.

12 Claims, 7 Drawing Figures

FLOOR SUPPORT FOR GRAIN DRYING AND STORAGE BIN

BACKGROUND OF THE INVENTION

The present invention relates generally to a floor support structure for a grain bin and more particularly, to a floor support structure for supporting a perforated floor in a grain drying and storage bin having a plenum chamber and a grain drying and storage chamber.

Grain drying and storage bins have existed in the prior art for many years. Such bins generally include a concrete base, a generally cylindrical housing of corrugated steel extending upwardly from the base and a roof. Within such housing, a perforated floor is supported in spaced relationship above the concrete base to provide a plenum chamber into which air is forced for circulation to the grain. The grain is contained within the corrugated steel housing above the perforated floor. In the past, many devices have been used to support the perforated floor above the concrete base. Some of these prior structures are illustrated in U.S. Pat. Nos. 3,426,445; 3,591,994 and 3,512,322. While some of these prior structures function satisfactorily, then tend to be quite expensive and exert high stresses against the perforated floor supported by them. This is particularly true in the structures in which the perforated floor is laid directly onto the exposed ends of the wire mesh supports. Additionally, there is always concern with regard to the load bearing capacity of such wire mesh supports and whether a sufficient number of supports are being used to support the contemplated load.

SUMMARY OF THE INVENTION

In contrast to the prior art, the present invention relates to a floor support for a grain drying and storage bin which is less expensive than prior art supports and which significantly reduces the concentration of stresses created in the perforated floor being supported. Additionally, the structure of the present invention is sturdier and is able to withstand approximately four times greater weight than the prior wire mesh structures.

Whereas many of the prior art supporting structures include conventional concrete reinforcement wire mesh bent into generally a "Z" shaped configuration, the supporting structure of the present invention includes a plurality of vertically disposed hollow tubular members which are retained together in the desired configuration by an upper and a lower brace member. It has been shown through calculations and experimental data that this structure of the present invention, due in large measure to the tubular support and contact with the perforated floor rather than the solid wire mesh posts of the prior art, significantly reduces the level of stress created in the perforated floor and increases the structural rigidity of the structures and the weight capable of being supported thereon.

The entire floor support for the grain drying and storage bin consists of a plurality of the units described above arranged in a desired pattern to provide adequate support for the perforated floor. Accordingly, the object of the present invention is to provide an improved floor support for a grain drying bin which is less expensive than prior art supports and which reduces the level of stress created in the perforated floor being supported.

Another object of the present invention is to provide a floor support for a grain drying and storage bin which gives increased support strength.

A further object of the present invention is to provide a floor support for a grain drying and storage bin in which the vertically disposed supporting elements comprise generally tubular sections.

These and other objects of the present invention will become apparent with reference to the drawings, the description of the preferred embodiment and the appended claims.

DESCRIPTION OF THE PREFERRED EMBODIMENT

Figure 1:
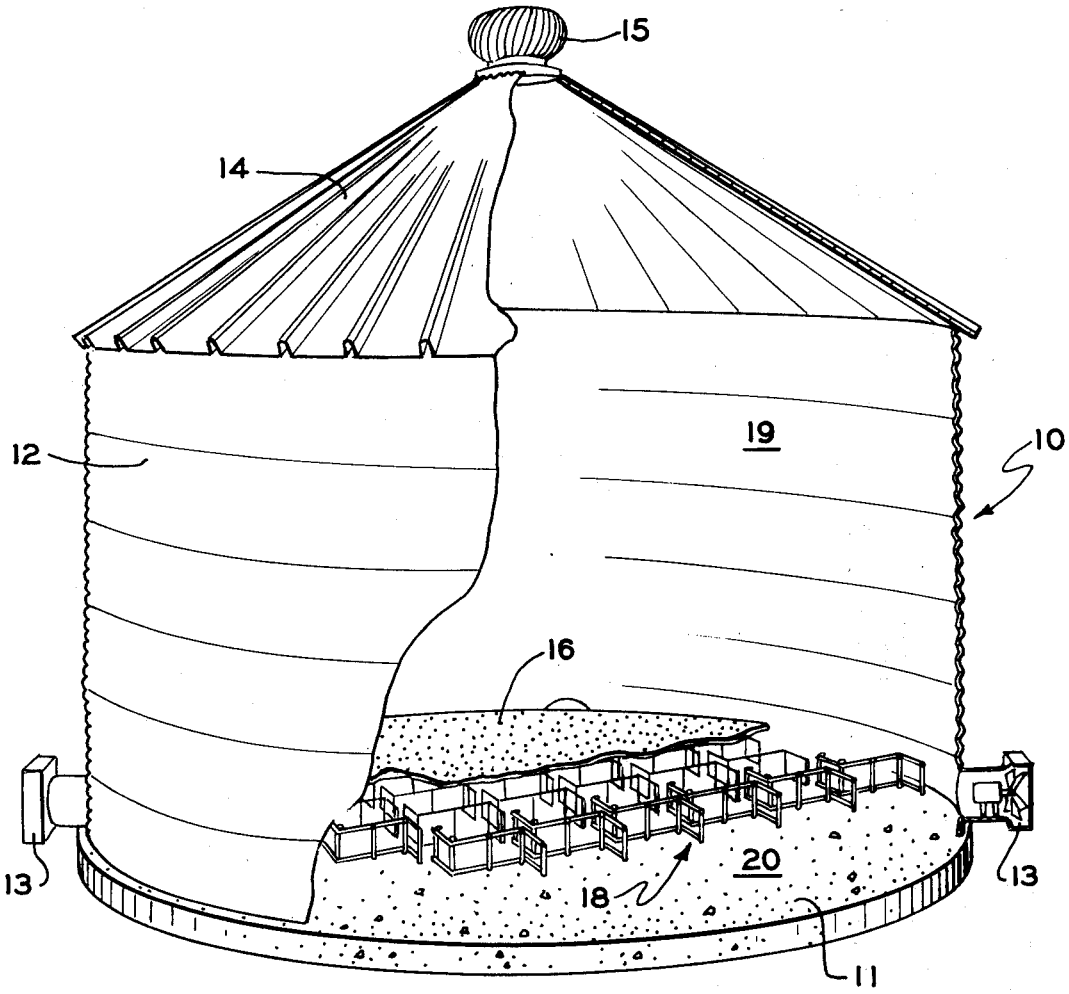
FIG. 1 is a pictorial view of a grain drying and storage bin showing the floor support of the present invention supporting a perforated floor.

Reference is first made to FIG. 1 which shows a pictorial view of a conventional grain drying and storage bin 10. Such bin includes a concrete base or platform 11, a generally cylindrical side wall 12 constructed of corrugated steel and extending upwardly from the base and an angled roof 14 sloping upwardly from the upper edge of the side wall 12. An exhaust port is located at the top of the roof 14 and a wind turbine 15 is positioned at the top of the exhaust port to ventilate the attic of the bin. During the drying operation, however, the wind turbine 15 is moved to the side to allow air to freely escape through the exhaust port without restriction of the turbine 15. A perforated floor 16 is supported within the grain drying and storage bin 10 in generally parallel relationship to, and spaced above the base 11. The floor 16 defines a grain drying and storage chamber 19 above the floor 16 and a plenum chamber 20 below. The perforated floor 16 is supported by a floor support system generally illustrated by the reference numeral 18 and made up of a plurality of floor support units. The floor support system supports the perforated floor in spaced relationship above the concrete platform 11 to permit air introduced by the plurality of fans 13 positioned about the lower periphery of the side wall 12 to force air into the plenum chamber 20, through the perforated floor 16, through the grain in the drying and storage chamber 19 and out through the exhaust port.

Figure 2:
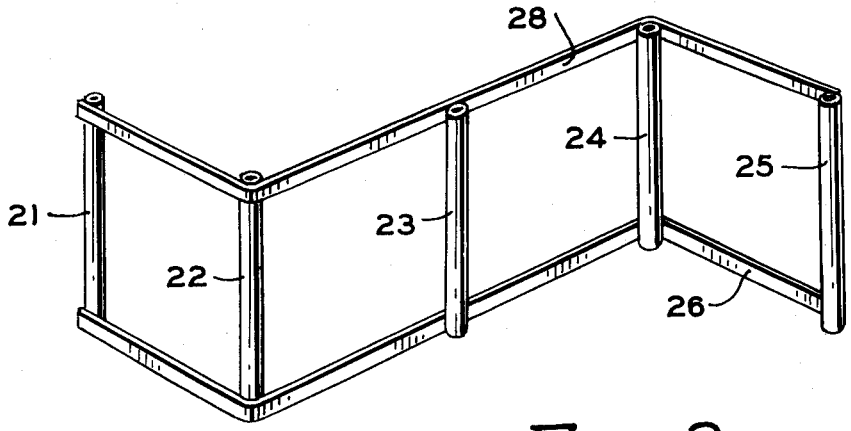
FIG. 2 is a pictorial view of the preferred embodiment of one of the supporting structures of the present invention.
Figure 3:
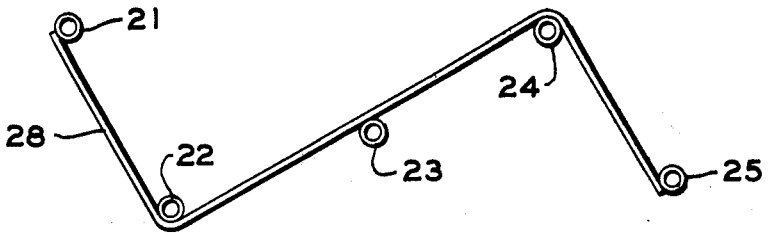
FIG. 3 is a top view of the supporting structure of FIG. 2.

As illustrated in the preferred embodiment of one of the floor support units shown in FIGS. 2 and 3, each of such units comprises a plurality of generally vertically disposed tubular members 21, 22, 23, 24 and 25 which are tied or connected together by a lower brace member 26 and an upper brace member 28. While the various vertical elements 21–25 can be of different cross-sectional configuration, it is important that such elements be of tubular construction with a hollow interior to obtain the benefits of the present invention. In the preferred embodiment, the tubular members 21–25 are circular in cross-section and are constructed of structural, thin-wall mechanical tubing. Although different sizes and types of tubing are acceptable, it has been found that ¾ inch O.D., 18 guage cold rolled mechanical tubing manufactured by Central Steel Tube, Inc. of Clinton, Iowa is satisfactory.

Figure 6:
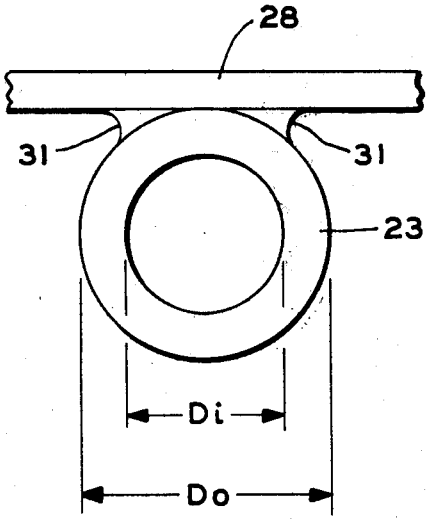
FIG. 6 is an enlarged top view of one of the cylindrical supporting posts connected to a support brace member.

The plurality of generally vertical tubular members are secured together by a pair of elongated brace members 26 and 28. The lower brace member 26 joins the tubular members 21–25 together along their bottoms and the upper brace member 28 joins the tubular members together along their tops. The brace members 26 and 28 can be secured to the vertical members in various ways; however, in the preferred embodiment, the brace members are secured to the tubular members by appropriate welds 39, 39 as shown in FIG. 6.

The brace members 26 and 28 can be of any cross-sectional configuration. In the preferred embodiment, however, they have a rectangular cross-section and are constructed of ¾ inch steel flat bar stock approximately ⅛ inch thick. Such brace members of the preferred embodiment may either be cut from a large sheet of steel or consist of a hot rolled strip with a milled edge.

As shown in FIGS. 2 and 3, the preferred embodiment of the individual floor support units are bent in a configuration having a central, linear section defined by the members 22, 23 and 24, two short end sections defined by the members 21 and 22 and the members 24 and 25, respectively. The end sections extend at right angles from the ends of the central, linear section and in opposite directions. Each of the central, linear sections and the end sections is defined by at least two of the vertical tubular sections and the corresponding portion of the connecting brace members 26 and 28. In the embodiment illustrated in FIGS. 2 and 3, the tubular members 21, 31 and 25 are shown as being disposed on one side of the brace members 26 and 28. It is contemplated, however, that any of these members 21, 23 and 25 can be on either side of the brace members 26 and 28. It is preferred that the members 22 and 24 be secured within the included angles of the brace members 26 and 28.

Figure 4:
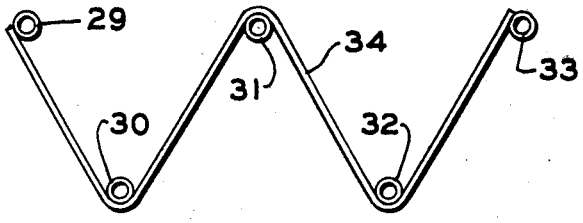
FIG. 4 is a top view of an alternate embodiment of a floor supporting structure of the present invention.
Figure 5:
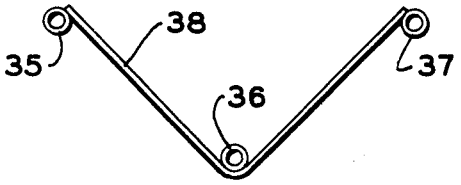
FIG. 5 is a top view of a further embodiment of a floor supporting structure of the present invention.

FIG. 4 shows an alternate embodiment of the floor support structure of the present invention. This structure as illustrated also has five vertically disposed tubular members 29, 30, 31, 32 and 33 and a pair of generally horizontal brace members 34 extending between the tubular supports 29–33 to secure the same together. Because FIG. 4 is a top view, the lower of the two brace members 34 is not specifically illustrated. It would, however, be positioned similar to that illustrated in the preferred embodiment of FIG. 2. In the embodiment of FIG. 4, the tubular members 29–33 and the connecting brace members 34 are arranged in an angular "W" shaped pattern forming angles of less than 180 degrees between adjacent sections of brace members. The structure of FIG. 4 as well as the preferred structure of FIGS. 2 and 3 and the alternate embodiment of FIG. 5 show the tubular members as being secured within the included angles formed by the brace members. In the embodiment of FIG. 4, the distance between adjacent tubular members is the same and lines intersecting alternate tubular members form two parallel lines. Also, the embodiment of FIG. 4 is shown as having five vertical tubular members, however, it is contemplated that greater numbers of tubular members could be used and thus longer runs of "W" shaped sections formed.

It is contemplated that the embodiment of FIG. 4 could be used to directly support the perforated floor as shown in FIG. 1 or used in conjunction with a plurality of elongated support members or stringers similar to a channel lock construction.

A further alternate embodiment is illustrated in FIG. 5. This embodiment shows a support structure having three vertical tubular members 35, 36 and 37 and a pair of generally horizontally disposed brace members 38 connecting the tubular members. Similar to the embodiment of FIG. 4, the embodiment of FIG. 5 is a top view and thus, the lower of the two brace members 38 is not specifically illustrated, but is similar to that illustrated in the preferred embodiment of FIG. 2. In all cases, the suport structures show a generally vertical tubular member being disposed within the included angles of the supporting braces, regardless of the specific configuration. It should also be noted that the floor support members must be capable of being free standing. Thus, each of the individual support members must include at least three vertical tubular members which are spaced apart in non-linear relationship.

Figure 7:
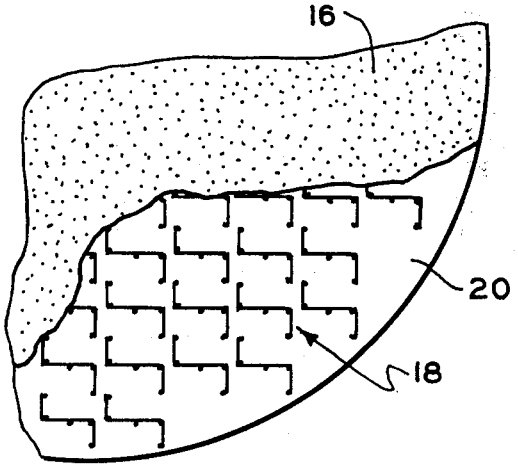
FIG. 7 is a plan view of the floor support structure showing the manner in which the floor support units are arranged.

In operation, a plurality of the individual support units such as those illustrated in FIGS. 2 and 3 are arranged on the cement base 20 to support the perforated floor 16. One such way of arranging the units is shown in FIG. 7. The units can also be arranged so that the opposite ends of the end sections are adjacent to each other or so that the end leg portions of an adjacent row of floor supports are equidistant between the two legs of the support unit in the given row. The advantage of this latter structure is that it results in a floor support pattern in which the flooring material has an unsupported span of no greater than the length of the end leg section which, in the preferred embodiment, is twelve inches. The units shown in FIGS. 4 and 5 can be similarly arranged or can be used in conjunction with the support units of FIGS. 2 and 3.

While the description of the preferred embodiment has been quite specific, it is contemplated that various modifications could be made to the specific embodiment without deviating from the spirit of the present invention. For example, the tubular sections could be arranged in a variety of possible configurations without deviating from the basic concept of providing a support for a perforated floor utilizing a plurality of such vertical tubular members. Thus, it is intended that the scope of the present invention be dictated by the appended claims rather than by the description of the preferred embodiment.

We claim:

1. A floor support for supporting a perforated floor in a grain drying and storage bin comprising a floor support unit having:

at least three vertically disposed tubular members, said tubular members being parallel to each other and disposed in a non-linear pattern to enable said floor support unit to be free standing; and first and second brace members for connecting said tubular members together to form said floor support unit, said first brace members being secured to each of said tubular members near the upper ends thereof in a load bearing position with respect to the perforated floor and said second brace members being secured to each of said tubular members near the lower ends thereof, said first brace member having a generally rectangular cross-section with opposing narrow side surfaces and opposing wide side surfaces, one of said narrow side surfaces being horizontally disposed along the upper ends of said tubular members for load bearing engagement with the perforated floor.

2. The floor support of claim 1 wherein each of said tubular members comprises a section of thin wall mechanical tubing.

3. The floor support of claim 1 wherein said floor support unit includes five vertically disposed tubular members arranged in a pattern having a central, linear section and a pair of end sections, extending at right angles from the ends of said central section in opposite directions.

4. The floor support of claim 3 wherein said central, linear section is defined by three of said five tubular members.

5. The floor support of claim 4 wherein said central, linear section is approximately twice as long as each of said end sections.

6. The floor support of claim 5 wherein said pair of brace members are secured to said tubular members by welding and extend continuously to join said tubular members in said pattern.

7. The floor support of claim 6 having a plurality of said floor support units arranged in generally adjacent relationship to each other for supporting said perforated floor.

8. The floor support of claim 1 wherein said tubular members are equally spaced from each other and are arranged in a generally extended "W" shaped pattern.

9. The floor support of claim 1 wherein each of said brace members is constructed of flat, steel bar stock.

10. The floor support of claim 9 wherein the cross-section of said brace members is rectangular and has dimensions of approximately $\frac{3}{4}$ inch by $\frac{1}{8}$ inch.

11. The floor support of claim 1 wherein the tubular members and connecting brace members are arranged in an angular pattern forming angles of less than 180 degrees and wherein said brace members are connected with said tubular members such that said tubular members are secured within the included angles formed by said brace members.

12. A grain drying and storage bin with an improved floor support comprising:

a concrete base;

a generally cylindrical housing extending upwardly from said base;

a perforated floor disposed within said housing, said floor being parallel to and spaced vertically from said concrete base; and a plurality of floor support units for supporting said perforated floor, each of said units including:

at least three vertically disposed tubular members, said tubular members being parallel to each other and disposed in a non-linear pattern to enable said floor support unit to be free standing; and first and second brace members for connecting said tubular members together to form said floor support unit, said first brace member being secured to each of said tubular members near the upper ends thereof in a load bearing position with respect to the perforated floor and said second brace member being secured to each of said tubular members near the lower ends thereof, said first brace member having a generally rectangular cross-section with opposing narrow side surfaces and opposing wide side surfaces, one of said narrow side surfaces being horizontally disposed along the upper ends of said tubular members for load bearing engagement with the perforated floor.

* * * * *